US005611387A

United States Patent [19]

Chadwick

[11] Patent Number: 5,611,387

[45] Date of Patent: Mar. 18, 1997

[54] MOULDING DEVICE

[75] Inventor: Geoffrey A. Chadwick, Winchester, United Kingdom

[73] Assignee: Hi-Tec Metals Limited, Hampshire, United Kingdom

[21] Appl. No.: 374,547

[22] PCT Filed: Jul. 23, 1992

[86] PCT No.: PCT/GB92/01350

§ 371 Date: Jan. 20, 1995

§ 102(e) Date: Jan. 20, 1995

[87] PCT Pub. No.: WO94/02271

PCT Pub. Date: Feb. 3, 1994

[51] Int. Cl.[6] ..... B22D 27/09; B22D 17/08

[52] U.S. Cl. ..... 164/113; 164/313

[58] Field of Search ..... 164/113, 312, 164/313, 303

[56] References Cited

U.S. PATENT DOCUMENTS

| | | | |
|---|---|---|---|
| 2,669,760 | 2/1954 | Venus . | |
| 4,436,140 | 3/1984 | Ebisawa et al. | 164/313 |
| 4,601,321 | 7/1986 | Tokui | 164/313 |
| 4,860,818 | 8/1989 | Dannoura | 164/113 |
| 5,188,165 | 2/1993 | Ivansson | 164/113 |

FOREIGN PATENT DOCUMENTS

| | | | |
|---|---|---|---|
| 0095513 | 12/1983 | European Pat. Off. . | |
| 56-136270 | 10/1981 | Japan | 164/313 |
| 57-4370 | 1/1982 | Japan | 164/313 |
| 58-148067 | 9/1983 | Japan | 164/313 |
| 2-1511360 | 6/1990 | Japan | 164/313 |
| 2-151358 | 6/1990 | Japan | 164/313 |
| 310261 | 4/1929 | United Kingdom . | |
| 2129343 | 5/1984 | United Kingdom . | |
| 2129343A | 5/1984 | United Kingdom | 164/113 |

OTHER PUBLICATIONS

Patent Abstracts of Japan, vol. 6, No. 267, M-182, abstract of JP,A,57-159251 (Toyota Jidosha Kogyo K.K.) 1 Oct. 82.

*Primary Examiner*—Joseph J. Hail, III
*Assistant Examiner*—I.-H. Lin
*Attorney, Agent, or Firm*—Beveridge, DeGrandi, Weilacher & Young, L.L.P.

[57] ABSTRACT

A moulding device having a moulding block with a moulding cavity formed therein. A chamber is connected to the cavity and has a mouth where the chamber is connected to the moulding cavity. A closing member is provided between the chamber and the cavity which is moveable from a first position in which the mouth of the chamber is sealed to allow the chamber to be charged with a molten substance while the piston is retracted to a second position which forms a narrow orifice such that a fine spray or jet or film of molten substance is forced at a high velocity through the narrow orifice to form a fine grain coating on the inner surface of the moulding cavity. The closing member can then be further retracted to provide for a second phase of molten substance injection which is carried out until the moulding cavity is full.

17 Claims, 2 Drawing Sheets

MOULDING DEVICE

CROSS-REFERENCE TO RELATED APPLICATION

This application is A 371 OF PCT/GB92/01350, filled Jul. 23, 1992.

FIELD OF THE INVENTION

The present invention relates to moulding devices, in particular, high pressure die casting machines and is particularly, although not exclusively, concerned with the production of metal castings having low porosity.

BACKGROUND OF THE INVENTION

There are a number of high pressure die casting devices/machines in use but many produce cast articles which have a high degree of porosity. If the level of porosity is allowed to rise above certain limits, the pores can adversely affect the properties of the component so as to lead to the failure or deterioration of the cast article during use (most porosity remains internal; only if the die castings are machined is the porosity usually exposed). Therefore, in any high pressure die casting device, an object will be to reduce the porosity levels as close to zero as possible.

A high pressure die casting (hpdc) machine which is used extensively is the "cold chamber" hpdc machine which manufactures aluminium alloys. This machine operates by transferring molten metal from a shot sleeve into a die cavity by means of a high velocity piston or plunger. The molten metal is forced along a series of channels or a runner system and through a fixed, narrow gate or opening into the die cavity. The liquid metal is then effectively sprayed through the gate to produce a first coating over the surface of the die cavity and then the remainder of the liquid metal is introduced into the cavity to complete the cast article. The first coating of liquid metal commonly produces a very fine grain surface layer having a very smooth surface finish. However, the cold chamber hpdc process suffers from two major disadvantages. First, because the molten metal has to flow through a runner system of channels, its temperature will fall by the time it reaches the narrow gate and consequently, it will freeze around the narrow gate which reduces the pressure which can be transmitted effectively from the runner and gate onto the metal in the die cavity. The reduction in pressure transmission will produce die castings which are notoriously porous and may, therefore, not be heat treatable for fear of blistering. Furthermore, subsequent machining operations will expose the porosity which causes a high rejection rate. Secondly, the cold chamber hpdc process is commonly only about 33% efficient because approximately 50% of the cast metal (i.e in the runner and gate sections) needs to be removed from each casting for remelting. Moreover, since there is an additional casting scrap rate of 5–15% the efficiency of the cold chamber hpdc process is rarely greater than 25% in material utilisation and considerably less than 20% in energy utilisation.

Several solutions have been proposed to reduce porosity. One such solution involves evacuating the die set prior to casting with a view to reducing gas entrapment. However, the casting still freezes or solidifies remote from the point of application of pressure and therefore, the solidifying casting cannot be fed from the reservoir of metal in the runner and wad. Hence, contraction cavities arise in the casting. A further solution proposed was to purge the die set with oxygen or another suitable gas which would combine spontaneously with the liquid metal to remove gas from the die set. However, contraction cavities are still formed. The mould is sprayed with a lubricant prior to the casting which evaporates on contact with the hot metal so that gases are still present in the mould. A slightly different approach was to apply enhanced pressure on the wad by a smaller secondary piston but porosity still exists in the casting due to remote application of the pressure and freezing off at the gate.

In order to attempt to limit the amount of porosity, another approach to high pressure die casting has been devised which is more accurately described as a "squeeze" casting. Squeeze casting is the term used to denote processes in which liquid metal is solidified under the action of a high external pressure. Two different types of squeeze casting technology have evolved based upon different approaches to metal metering and metal movement and also upon the manner in which the pressure is applied to the metal in the mould. These two processes have been given the names "direct" and "indirect" squeeze casting.

In direct squeeze casting, the die set is a split mould consisting of a lower female cavity and an upper male punch. Sufficient pressure is applied to the punch, which moves to compress the liquid/solid mixture during freezing to suppress the appearance of either gas porosity or shrinkage porosity in the casting. Direct squeeze casting is thus a hybrid process combining gravity die casting with closed die forging.

In indirect squeeze casting, liquid metal is injected into a closed die cavity by a small diameter piston, by which mechanism the pressure is also applied during freezing. Squeeze pressures are limited by the size of the piston and, for large area castings, some thin sections of the casting may freeze off locally and prevent the transmission of pressure to remoter regions thus allowing porosity to form. The current art of indirect squeeze casting uses vertical injection of liquid metal into the die set which has either a vertical or horizontal opening.

It is to be appreciated that squeeze casting can produce much lower levels of porosity than high pressure die casting and therefore, a combination of both types of casting would be desirable. In hpdc (usually horizontal machines) the wad and runners are the only parts which are pressurised to a maximum extent because the gate freezes or solidifies and then the metal in the die freezes under low pressure. In indirect squeeze casting (vertical or horizontal machines), the same is also true but to a lesser extent because the gates are wide open and are of fixed geometry.

SUMMARY OF THE INVENTION

According to the present invention there is provided a moulding device comprising a moulding block defining a moulding cavity therein, a chamber connected to the cavity in which a piston is slidable, characterised in that a closing means is provided between the chamber and the cavity, the closing means being moveable from a first position, in which the mouth of the chamber is sealed to allow the chamber to be charged with a molten substance whilst the piston is in a retracted position, to one or more further positions which allow the molten substance to be injected directly into the cavity when the piston is activated, characterised in that the closing means is moveable to a second position spaced at a small distance from the mouth of the chamber to define a narrow orifice such that a fine spray or jet or film of molten substance is forced through the orifice and is deposited on the inner surface of the cavity when the piston is activated.

An advantage of the present invention is that because the piston acts directly on the molten substance in the mould rather than via a runner system and narrow gate, porosity levels will be reduced as there will be little or no freezing of the molten substance at the gate into the block. Whether the molten substance is introduced in spray, jet or film form will depend on the substance used.

The initial spraying of molten substance produces a good surface quality in the moulded article.

Preferably, the closing means can be moved into a third retracted position which allows a less restricted entry of molten substance into the cavity.

Preferably, the closing means slides through a wall of the cavity.

Preferably, the closing means slides through a wall of the cavity opposite to the mouth of the chamber into the cavity.

By locating the closing means opposite to the mouth into the cavity it is possible to have a symmetrical arrangement which will allow a regular spray pattern to be produced when the closing means is only partially retracted.

Preferably, when the closing means is fully retracted it forms part of the inner surface of the cavity.

Preferably, the closing means is a pillar which is slidable in a sleeve.

Preferably, the device is for use in high-pressure die casting or indirect squeeze casting of metals.

The present invention further provides a method of moulding an article in a moulding block, the moulding block defining a moulding cavity therein and a chamber connected to the cavity in which a piston is slidable, comprising the steps of closing the mouth of chamber, charging the chamber with a molten substance, opening the mouth to the block to directly inject the molten substance into one or more moulding cavities within the moulding block by moving a piston slidable in the chamber, characterised in that the mouth to the block can be partially opened to define a narrow orifice such that when the piston is operated, a fine spray or jet or film of the molten substance is forced through the orifice and deposited on the inner surface of the moulding cavity or cavities.

Preferably, the mouth to the block can be opened further to allow less restricted entry of the molten substance into the cavity.

BRIEF DESCRIPTION OF THE DRAWINGS

Preferably, the method includes the step of creating a temperature gradient such that the temperature at the centre of the moulding cavity (2) is greater than the temperature at its periphery.

A preferred embodiment of the present invention will now be described in detail, by way of example only, with reference to the accompanying drawings, of which.

DETAILED DESCRIPTION OF THE PREFERRED EMBODIMENTS

Figure 1:
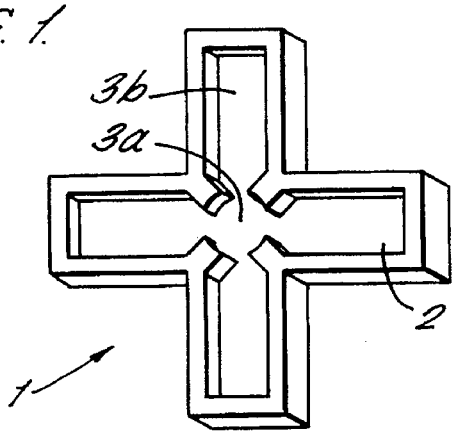
FIG. 1 depicts a multi-cavity moulding block in perspective.

FIG. 1 shows a moulding block 1 used for die casting of metals. The block 1 has a moulding cavity 2 which comprises a central region 3*a* and four leg cavities 3*b*. The central region 3*a* will form what is known as the "wad" or "biscuit" and the cavities 3*b* will form four "legs" or "coupons". Clearly, the "coupons" could be in any shape depending on end requirements.

Figure 2:
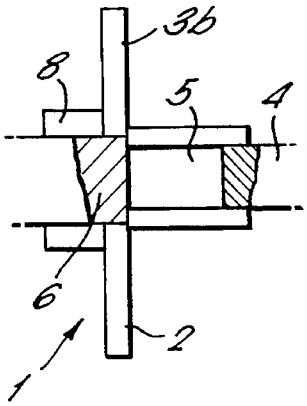
FIG. 2 is a side view of the block in FIG. 1 connected to a piston/closing means arrangement in a closed position according to a first preferred embodiment of the present invention.

FIG. 2 is a schematic side view of the block 1 when connected to a piston 4 (shown partially in cross-section in the figures) which is slidable in a chamber 5. In FIG. 2 a pillar 6 (shown partially in cross-section in the figures) which is slidable in a sleeve 8 seals the central region 3*a* and the piston 4 is fully retracted. Chamber 5 will be charged with molten metal in this position.

Figure 3:
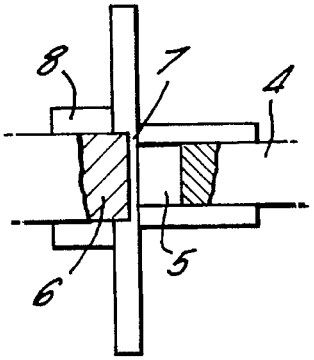
FIG. 3 is a side view of the arrangement in FIG. 2 partially open.

FIG. 3 shows the arrangement when the pillar 6 has been partially withdrawn to produce an annular gap or gate 7 through which the molten metal can pass. The piston 4 will be pushed towards the central region 3*a* and a fine spray of molten metal will coat the inner surface of the four leg cavities 3*b*.

Figure 4:
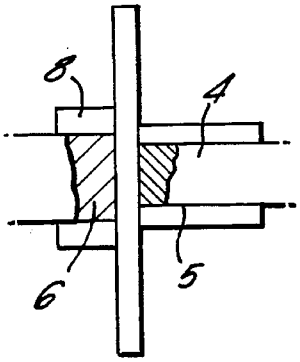
FIG. 4 is a side view of the arrangement in FIG. 2 fully open.

FIG. 4 shows the pillar 6 fully retracted such that it clears the region 3*a* forming a wall of the region 3*a*. The piston 4 is pushed to its extreme position to inject all the molten metal into the region 3*a* and leg cavities 3*b*.

Figure 5:
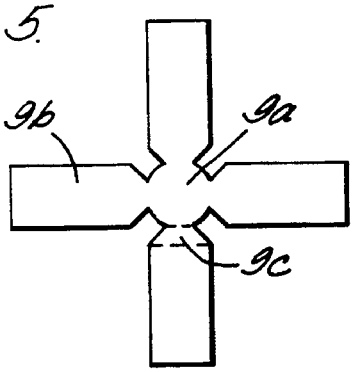
FIG. 5 depicts a casting produced by the moulding block in FIG. 1.

FIG. 5 depicts a casting produced by the moulding block in FIG. 1. There is a central "wad" 9*a*, four "legs" 9*b* which are generally rectangular in shape and each of which is connected to the central wad 9*a* by a substantially triangular runner 9*c*.

Figure 6:
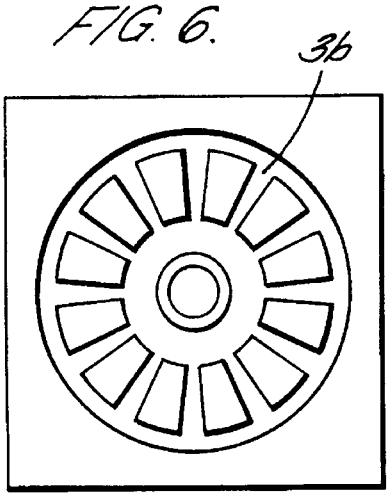
FIG. 6 depicts the moulding block used to produce a typical wheel centre which can be cast using the moulding device of the present invention.
Figure 7:
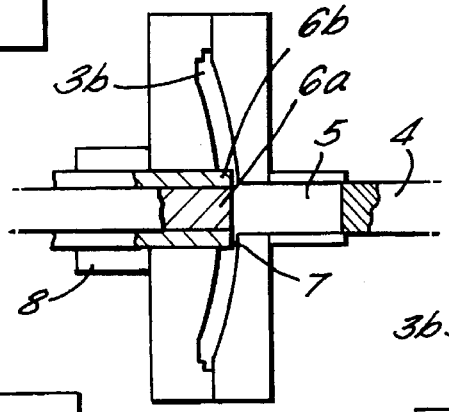
FIGS. 7 and 8 show a second preferred embodiment of the moulding device comprising the moulding block in FIG. 6.
Figure 8:
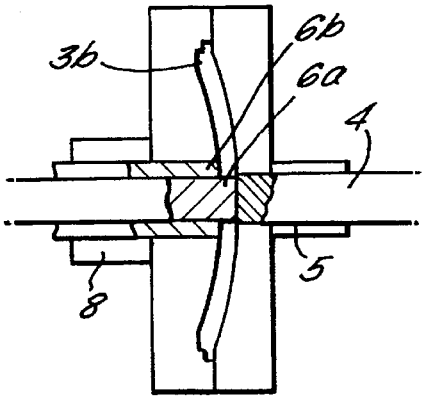

FIG. 6 depicts a moulding block for a typical wheel centre which can be produced in accordance with the moulding device of the present invention. Like reference numerals represent like features to those in FIGS. 1 to 5. FIGS. 7 and 8 show the configuration of a suitable moulding device used to produce such a wheel centre. In FIG. 7, the piston 4 is fully retracted and the pillar is in the position which seals the moulding cavity 2 from the chamber 5.

In this embodiment, the pillar comprises a fixed inner cylinder 6*a* and a slidable outer cylinder 6*b*. When outer cylinder 6*b* is withdrawn, a narrow gap or gate 7 is produced through which the molten metal can pass. This type of geometry is useful in moulding wheel centres, for example, so that excess metal in the centre can be avoided.

Figure 9:
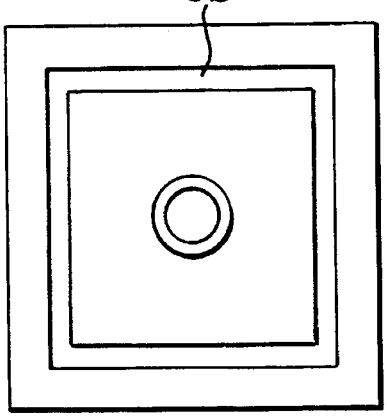
FIG. 9 depicts a simple square plate (single cavity) moulding block in perspective.
Figure 10:
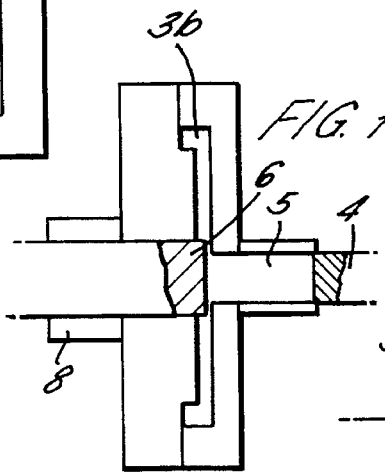
FIGS. 10 and 11 show a third preferred embodiment of the moulding device comprising the moulding block in FIG. 9.
Figure 11:
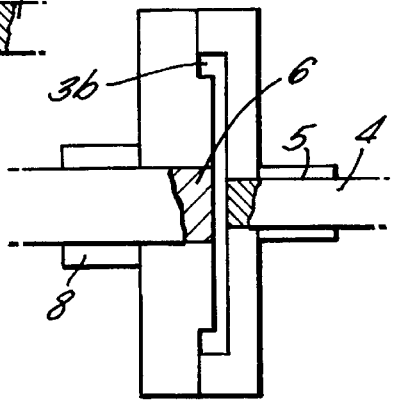

FIG. 9 depicts a simple square plate single cavity moulding block. FIGS. 10 and 11 depict the moulding device which could comprise such a moulding block before and after actuation of the pillar 6 and piston 4.

In use, liquid alloy in sufficient quantity to fill the moulding cavity 2 comprising a central region 3*a* and several leg cavities 3*b* is poured, pumped or syphoned into the shot sleeve 5. The piston 4 is retracted and the pillar 6 is in a position to close off the sleeve 5 from central region 3*a*. As piston 4 is moved forwards, pillar 6 is moved to a position which creates a gap or gate 7 through which the liquid alloy is injected at high velocity into the moulding cavity 2. This first phase of injection coats the moulding cavity 2 with a skin of alloy which solidifies with a smooth surface finish and which possesses a fine grain size. The pillar 6 is then withdrawn to a further position and further liquid alloy is injected through the wider gate until the moulding cavity 2 is full of alloy. Pressure is maintained on the central wad 3*a* formed in the central region by piston 4 effectively squeezing the cast alloy until it has solidified. In order to minimise the porosity in the casting, it is desirable to apply a gradient of temperature from the periphery of the moulding cavity 2 (i.e the tips of leg cavities 3*b*) to its central region 3*a*. The central region 3*a* will then be hottest so as to remain liquid for the longest time to allow alloy to be fed to the extremeties of the casting as the alloy progressively solidifies. It has been found that wheel centres made in this way are of extremely high quality and have negligible porosity.

The sleeve 5 could be positioned between a number of small die cavities. The pillar 6 region would then produce a wad of waste metal between the castings but the runner system would be decreased.

It is preferable if the pillar 6 is machined along its length to create grooves through which gas can be evacuated from the moulding cavity 2. When the pillar 6 is in a closed position (e.g FIG. 2) the grooves would emerge into the central region 3*a* and allow air or another gas to be extracted. When the pillar 6 is partially retracted (e.g FIG. 3) the grooves would be enclosed by a tool steel sleeve 8 which would prevent access of liquid metal from central region 3*a* into the vacuum system.

Clearly, the fully retracted position will determine the thickness of the final casting.

Furthermore, the pillar need not be a solid cylindrical construction as depicted in FIGS. 7 and 8.

Typically, the pillar will be made of tool steel or iron-nickel or an iron-nickel-cobalt alloy of low expansion coefficient. The front face can be coated with thin layers of, for example, $Al_2O_3$/TiN. Usually the pillar will slide in a tool steel sleeve 8. Additionally, copper alloy bushings or rings could be provided between the pillar 6 and sleeve 8 to conduct heat away and to limit the separation between the pillar and sleeve.

Alternatively, other high temperature materials such as sialons or other ceramics could be used to make the pillar.

Although aluminium alloys have been discussed, it is intended that the present invention will use magnesium and other alloys as well as solid/liquid slurries (rheocasting and thixocasting) and particulate metal matrix composites.

Clearly, the moulding device of the present invention will overcome the problems of partial freezing of the molten metal prior to entering the moulding cavity and will benefit from the effects of squeeze casting as the piston pressure acts directly on the liquid in the cavity rather than via a long runner system. As mentioned earlier, it is envisaged that the moulding device of the present invention could be used both in die casting arrangements ("cold chamber" and "hot chamber") and in injection moulding arrangements with minor design modifications to suit end requirements.

I claim:

1. A moulding device comprising a moulding block (1) defining a moulding cavity (2) therein, a chamber (5) connected to the cavity (2) in which a piston (4) is slidable and the chamber (5) having a mouth where the chamber is connected to the moulding cavity, characterised in that a closing means (6) is provided between the chamber (5) and the cavity (2), the closing means being moveable from a first position, in which the mouth of the chamber (5) is sealed to allow the chamber to be charged with a molten substance whilst the piston (4) is in a retracted position, to one or more further positions which allow the molten substance to be injected directly into the cavity (2) when the piston (4) is activated, characterised in that the closing means (6) is moveable to a second position spaced at a small distance from the mouth of the chamber (5) to define a narrow orifice (7) such that a fine spray or jet or film of molten substance is forced through the orifice and is deposited on the inner surface of the cavity (2) when the piston is activated.

2. A device as claimed in claim 1, characterised in that the closing means (6) can be moved into a third position which allows a less restricted entry of molten substance into the cavity (2).

3. A device as claimed in claim 1 characterised in that the closing means (6) slides through a wall of the cavity (2).

4. A device as claimed in claim 3, characterised in that the closing means (6) slides through a wall of the cavity (2) opposite to the mouth of the chamber (5) into the cavity (2).

5. A device as claimed in claim 3, characterised in that when the closing means (6) is fully retracted it forms part of the inner surface of the cavity (2).

6. A device as claimed in claim 1, characterised in that the closing means (6) is provided with channels which allow evacuation of gas from the moulding cavity (2).

7. A device as claimed in claim 1, characterised in that the closing means (6) is a pillar which is slidable in a sleeve (8).

8. A device as claimed in claim 7, characterised in that a copper alloy collar is provided between the pillar (6) and sleeve (8) to increase conduction of heat away from the device.

9. A device as claimed in claim 1 for use in high-pressure die casting or indirect squeeze casting of metals.

10. A device as claimed in claim 1 characterised in that the moulding cavity (2) comprises a plurality of moulding sub-cavities.

11. A device as claimed in claim 1 wherein said closing means includes a fixed inner cylinder and a slideable outer cylinder with said inner cylinder having a diameter less than that of the mouth of said chamber.

12. A method of moulding an article in a moulding block (1), the moulding block (1) defining at least one moulding cavity (2) therein and the at least one moulding cavity (2) being connected to a chamber (5) in which a piston (4) is slidable, and the chamber (5) having a mouth where it is connected to said at least one moulding cavity (2), comprising the steps of closing the mouth of chamber (5), charging the chamber (5) with a molten substance, opening the mouth to the block (1) to directly inject the molten substance into one or more moulding cavities (2) within the moulding block (1) by moving a piston (4) slidable in the chamber (5), characterised in that the mouth to the block (1) is partially opened to define a narrow orifice (7) such that when the piston (4) is operated, a fine spray or jet or film of the molten substance is forced through the orifice (7) and deposited on an inner surface of the moulding cavity or cavities (2).

13. A method as claimed in claim 12, characterised in that the mouth to the block is opened further to allow less restricted entry of the molten substance into the cavity (2).

14. A method as claimed in claim 12, characterised by the step of creating a temperature gradient such that the temperature at the centre of the moulding cavity (2) is greater than the temperature at its periphery.

15. A method as claimed in claim 12 wherein said mouth is partially opened by repositioning a closing member from a first position wherein the mouth is blocked to a second position where the narrow orifice is created between one end of said closing member and said mouth.

16. A method as claimed in claim 12 wherein said moulding block includes a closing member that has an inner cylinder portion and an outer cylinder portion and said method further comprising repositioning said closing member by shifting the outer cylinder portion away from the mouth while maintaining the inner cylinder portion fixed with respect to the mouth.

17. A method of moulding an article in a moulding block, the moulding block defining a moulding cavity being connected to a chamber within which a piston is slideable, and the chamber having an outlet end opening into said moulding cavity, comprising:

positioning a closing member in a first position so as to close the outlet end of the chamber;

charging the chamber with a molten substance while said piston is in a retracted state;

repositioning the closing member to a second position to define a narrow orifice between said closing member and the outlet end of said chamber;

activating the piston while said closing member is at the second position so as to produce a first phase of molten substance injection wherein a fine spray or jet or film of the molten substance is forced through the orifice such that an inner surface of the moulding cavity is coated with a fine grain size coating of the injected molten substance;

further repositioning the closing member to a third position wherein said closing member is further removed from the outlet end of said chamber than in said second position; and further injecting the molten substance while said closing member is at the third position so as to produce a second phase of molten substance injection which is different than the first phase and wherein the molten substance is fed into the moulding cavity until the moulding cavity is filled.

* * * * *